United States Patent [19]

McCaleb

[11] 4,445,573

[45] May 1, 1984

[54] INSULATING FOAM STEAM STIMULATION METHOD

[75] Inventor: George E. McCaleb, Bakersfield, Calif.

[73] Assignee: Thermal Specialties Inc., Bakersfield, Calif.

[21] Appl. No.: 439,126

[22] Filed: Nov. 4, 1982

[51] Int. Cl.[3] ..... E21B 33/138; E21B 43/24; E21B 47/06

[52] U.S. Cl. ..... 166/250; 166/272; 166/294; 166/303; 166/309

[58] Field of Search ..... 166/250, 252, 269, 272, 166/288, 294, 303, 309

[56] References Cited

U.S. PATENT DOCUMENTS

| | | | |
|---|---|---|---|
| Re. 27,459 | 8/1972 | Guinn et al. | 166/250 |
| 3,358,759 | 12/1967 | Parker | 166/272 X |
| 3,410,344 | 11/1968 | Cornelius | 166/303 |
| 3,412,793 | 11/1968 | Needham | 166/272 |
| 3,412,794 | 11/1968 | Craighead | 166/272 |
| 3,464,491 | 9/1969 | Froning | 166/272 X |
| 3,524,502 | 8/1970 | Sloan | 166/250 |
| 3,674,092 | 7/1972 | Bandyopadhyay | 166/272 X |
| 3,893,511 | 7/1975 | Root | 166/305 R |
| 3,993,133 | 11/1976 | Clampitt | 166/272 |
| 3,994,345 | 11/1976 | Needham | 166/303 |
| 4,068,717 | 1/1978 | Needham | 166/272 |
| 4,085,800 | 4/1978 | Engle et al. | 166/288 |
| 4,086,964 | 5/1978 | Dilgren et al. | 166/272 |
| 4,124,073 | 11/1978 | Wier | 166/272 |
| 4,161,217 | 7/1979 | Dilgren et al. | 166/252 |
| 4,247,405 | 1/1981 | Wier | 166/272 X |
| 4,300,634 | 11/1981 | Clampitt | 166/272 |

OTHER PUBLICATIONS

Bernard et al., "Effect of Foam on Permeability of Porous Media to Gas", *Society of Petroleum Engineers Journal*, Sep. 1964, pp. 267–274.

*Primary Examiner*—George A. Suchfield
*Attorney, Agent, or Firm*—Seed and Berry

[57] ABSTRACT

A method for recovering oil from a subterranean oil-bearing reservoir by steam stimulation where the reservoir includes a permeable zone and an oil-bearing strata utilizing a non-condensible, thermally insulating foam injected into the reservoir to substantially fill an expanse of the permeable zone in proximity with the portion of the oil-bearing strata to be stimulated.

18 Claims, 5 Drawing Figures

INSULATING FOAM STEAM STIMULATION METHOD

BACKGROUND OF THE INVENTION

The present invention relates to the recovery of oil from a subterranean oil-bearing reservoir utilizing steam stimulation, and more particularly, to an improved steam stimulation method for increasing oil recovery by utilizing a foam to reduce the loss of steam and steam supplied heat to permeable zones.

In oil well production, it is a conventional stimulation technique to inject steam into oil wells to increase the production of highly viscous oil from those wells, particularly after it has become uneconomical to produce only free-flowing oil. One common method is the cyclic steam stimulation method, wherein production of oil from a well is periodically interrupted and steam is injected into the well. The steam supplies heat to reduce the viscosity of the oil remaining in the oil-bearing strata surrounding the well so that it will flow more readily into the well for production therefrom. A second method is the direct drive injection of steam into an injection well whereby oil in the oil-bearing strata has its viscosity reduced, and is driven ahead of the steam being injected and produced from a nearby production well.

One of the problems faced with either method of steam injection arises from the varying permeabilities of the reservoir. Where there is a permeable zone with a considerable increase in permeability when compared to the oil-bearing strata, the injected steam will flow into the permeable zone preferentially, or on occasion almost exclusively. Since the oil to be produced may be very largely in the less permeable oil-bearing strata, a considerable quantity of steam will be injected into the well with little success and at great cost in time, money and energy.

Another problem encountered is the loss of a portion of the heat already transferred to the oil-bearing strata by the steam as a result of its conduction away into the permeable zone. The permeable zone may be comprised of a portion of the oil-bearing strata which has been substantially depleted of oil during prior production, and various combinations of highly permeable strata, cavities, voids, channels and fingers in the reservoir.

One attempted solution to at least part of this problem is to plug or seal off the highly permeable zone from the well so that the steam injected into the well is directed only into the less permeable oil-bearing strata. One such method is described in U.S. Pat. No. 3,412,793, which uses a foam formed in situ with a condensible gas, such as steam, as its gas phase. A steam-surfactant mixture is injected into the well and foams in the reservoir by the action of the steam passing through the permeable zone.

While use of such a self-collapsing steam-foam avoids the problem mentioned in the patent of plugging the permeable zone using a water solution of a surface active agent which takes a significantly longer and uncertain period to collapse, a significant disadvantage of the method described in the patent is that it only plugs the portion of the permeable zone adjacent to the well to prevent entry of steam directly from the well. The method does not, however, prevent steam injected into the oil-bearing strata from migrating out of the oil-bearing strata and into the permeable zone at points far removed from the vicinity of the well, which results in a substantial loss of heat content.

In many reservoirs where the portion of the oil-bearing strata to be stimulated extends a substantial distance from the well, the mere injection of additional steam-surfactant mixture into the permeable zone in an attempt to significantly extend the plugged portion is of no avail since as the steam-foam begins forming adjacent to the well it also begins inhibiting the steam from penetrating the permeable zone. As the source of steam to the permeable zone becomes more blocked, less foam is formed and consequently the penetration of foam into the permeable zone is also inhibited. Additionally, because the continued presence of heat is required to prevent the collapse of the foam, the foam which does reach farthest into the permeable zone cools off and collapses early because of condensation and the inability to supply sufficient steam vapor to heat and maintain the foam. Since the portions of the permeable zone most removed from the well are the portions least heated by the steam-foam, the foam therein is the least stable. As will be discussed below, preheating of the permeable zone with a hot gas may help the situation; however, there are certain reservoirs which have void spaces and extremely permeable areas where enough steam-foam or heated gas cannot be injected within practical limits to create pressure and temperature conditions sufficient to maintain the steam-foam for any useful period of time.

Another disadvantage of the method described in the U.S. Pat. No. 3,412,793 is that the full benefit of the heat already transferred to the oil-bearing strata by the steam may be lost by conduction of that heat or a significant portion thereof into the permeable zone. The problem of loss of heat by conduction in a well being stimulated by steam injection is recognized in U.S. Pat. No. 3,412,794. To the extent that the foam being used to plug the permeable zone does extend some distance out from the well into the permeable zone, since steam is commonly used as a gas phase, the foam actually increases the thermally conductivity of the permeable zone and aids in the conduction of heat away from the oil-bearing strata.

Other problems encountered with use of the method described in the U.S. Pat. No. 3,412,793 are discussed in U.S. Pat. No. 4,085,800, and include the need to heat the permeable zone prior to its plugging with foam to avoid using a portion of the steam-surfactant mixture injected just to heat the zone to a high enough temperature to form the foam. Without such preheating, a portion of the steam-surfactant mixture is wasted during the initial stage of operation, and a large amount of liquid is formed inside the permeable zone which will interfere with any subsequent oil production therefrom and will accelerate the heat transfer from the foam, thereby reducing its useful life. The same problems will be encountered with condensible foams other than steam-foam. A solution is suggested in the U.S. Pat. No. 4,085,800 patent of using a hot gas, such as carbon dioxide, nitrogen, methane or other noncondensible gases, to preheat the permeable zone, however, such is costly in terms of time, money and energy expendited.

It will therefore be appreciated that there has long been a need for a steam stimulation method which uses collapsible foam of prolonged stability to prevent the injected steam from entering permeable zones directly from the well and indirectly by migration through the oil-bearing strata, and which further insulates the oil-bearing strata from the permeable zone to prevent loss of heat by conduction. Ideally, the method should not require costly preheating of the permeable zone to avoid the waste of surfactant and the injection of excessive amounts of liquid into the permeable zone. The present invention fulfills these needs, and further provides other related advantages.

SUMMARY OF THE INVENTION

The present invention resides in a method for recovering oil from a subterranean oil-bearing reservoir, utilizing a single well operated by steam stimulation, the reservoir having a permeable zone and an oil-bearing strata with a portion thereof to be stimulated by steam injection, which comprises the steps of: forming foam using a substantially non-condensible gas and a solution containing a sufficient amount of a surface active agent and a liquid, the formed foam being relatively stable, substantially non-condensible, thermally insulating and having the non-condensible gas as a gas phase; injecting the formed foam into the well until achieving a well bore injection pressure of the foam approaching a maximum stabilization injection pressure, but not exceeding the reservoir fracturing pressure, to position the foam in the permeable zone and substantially fill with the foam an expanse of the permeable zone which extends substantially radially from the well to the extent the permeable zone is in substantial proximity with the portion of the oil-bearing strata to be stimulated, to form a thermally insulating barrier to reduce loss of steam and heat from the oil-bearing strata to the permeable zone; injecting into the reservoir through the well after formation of the thermally insulating barrier a sufficient amount of steam to heat the portion of the oil-bearing strata to stimulate oil production therefrom; and withdrawing oil from the reservoir through the well. The method may also be practiced by prior to injecting the formed foam into the well, injecting a sufficient amount of steam into the reservoir through the well to substantially eliminate any fluids from the well and from the expanse of the aforesaid permeable zone. Additionally, prior to withdrawing oil from the reservoir, substantially all steam injection into the reservoir may be terminated and heat permitted a sufficient period of time to soak from the injected steam into the portion of the oil-bearing strata being stimulated.

The method may also include continuing the steam injection to stimulate production beyond achieving a stabilization well bore injection pressure, and monitoring the well bore injection pressure of the injected steam during the soak period. If the injection pressure decreases to or about the stabilization injection pressure, then repeating the steps of forming and injecting foam to position additional foam in the expanse of the permeable zone and the step of injecting steam to provide additional steam in the reservoir. The foam is formed at or about the surface of the well, and the substantially non-condensible gas is at least one of air, nitrogen or carbon dioxide. Steam or pressurized air may be used as a carrier of the foam to position the foam in the permeable zone. The liquid used with the surface active agent may be water.

Another use of the method of the present invention is in recovering oil from a subterranean oil-bearing reservoir utilizing an injection well operated by steam stimulation and a laterally spaced production well. With this use the foam and steam used in practicing the invention are injected into the injection well, and the oil is withdrawn from the reservoir through the production well.

Other features and advantages of the invention will become apparent from the following detailed description, taken in conjunction with the accompanying drawings.

DETAILED DESCRIPTION

Figure 1:
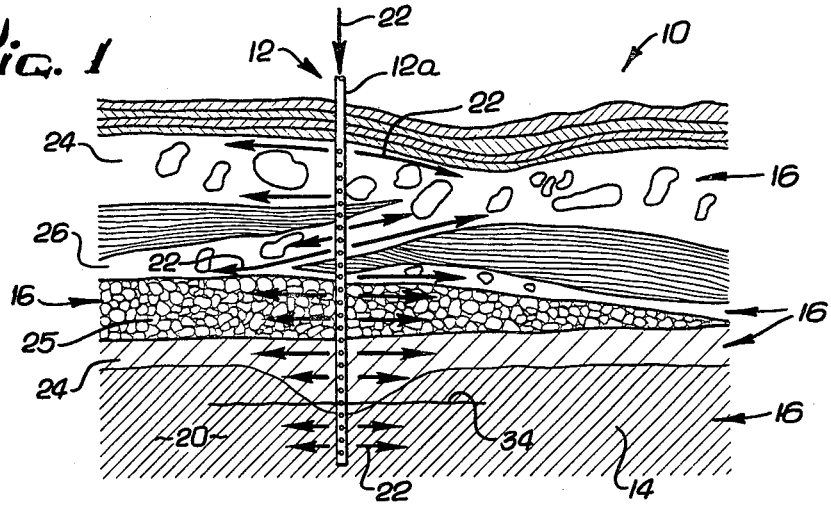
FIG. 1 shows a cross section of a reservoir using cyclic steam stimulation prior to use of the method of the present invention, indicating the paths of steam travel.

The present invention is embodied in a steam stimulation method for increasing oil recovery from a reservoir, indicated generally by reference numeral 10, penetrated by one or more wells 12, and containing an oil-bearing strata 14 and a permeable zone 16 of significantly higher permeability, utilizing a foam. Drawings are provided for purposes of illustration.

It is a conventional stimulation technique to inject steam into oil wells 12 to increase the production of highly viscous oil 20 contained in the oil-bearing strata 14 from the wells, once production of free-flowing oil has become uneconomical. The technique may be used with a single well **12*a* by periodically interrupting oil production from the well and injecting steam, indicated by arrows 22, into the well. The steam supplied heat reduces the viscosity of the oil 20 in the oil-bearing strata 14 surrounding the well 12*a*** so that it flows more readily into the well for production therefrom. When used in such a manner, the technique is commonly called cyclic steam stimulation.

The technique may also be used with two or more wells by injecting steam 22 into one well designated an injection well **12*b*, and withdrawing oil from one or more laterally spaced wells designated production wells 12*c*. The steam 22 reduces the viscosity of the oil 20 in the oil-bearing strata 14 and drives the oil ahead of the steam toward the production well 12*c*** from which it will be produced. When used in such a manner, the technique is commonly called direct drive steam injection.

With either manner of using the steam injection technique, it is recognized that the technique may fail if there exists a permeable zone 16 with significantly higher permeability than the oil-bearing strata 14. Such a permeable zone frequently results when a portion 24 of the oil-bearing strata is substantially depleted of oil during prior production. A permeable zone may also include a highly permeable strata 25, and fingers, cavities, voids, channels and other formations 26 in the reservoir which act to channel steam 22 away and prevent it from entering the oil-bearing strata 14 which is to be stimulated by the injection of steam.

In accordance with the invention, a method is provided for recovering highly viscous oil 20 from a subterranean oil-bearing reservoir 10 using steam injection where the reservoir has an oil-bearing strata 14 with a portion thereof, indicated by broken line 28, to be stimulated and a permeable zone 16 with a significantly higher permeability than the oil-bearing strata, utilizing a foam, indicated by arrows 30, formed with a substantially non-condensible gas and a solution containing a sufficient amount of a surface active agent and a liquid to form a relatively stable, substantially non-condensible, thermally insulating foam having the non-condensible gas as a gas phase. The formed foam 30 is injected into one of the wells 12*a* or 12*b* to position it in the permeable zone 16 and substantially fill with the foam an expanse, indicated by broken line 32, of the permeable zone which extends substantially radially from the well to the extent the permeable zone is in substantial radial proximity with the portion 28 of the oil-bearing strata 14 to be stimulated. When in place, the foam 30 forms a thermally insulating barrier to reduce loss of steam and heat from the oil-bearing strata 14 to the permeable zone 16 during subsequent steaming of the reservoir.

Figure 2:
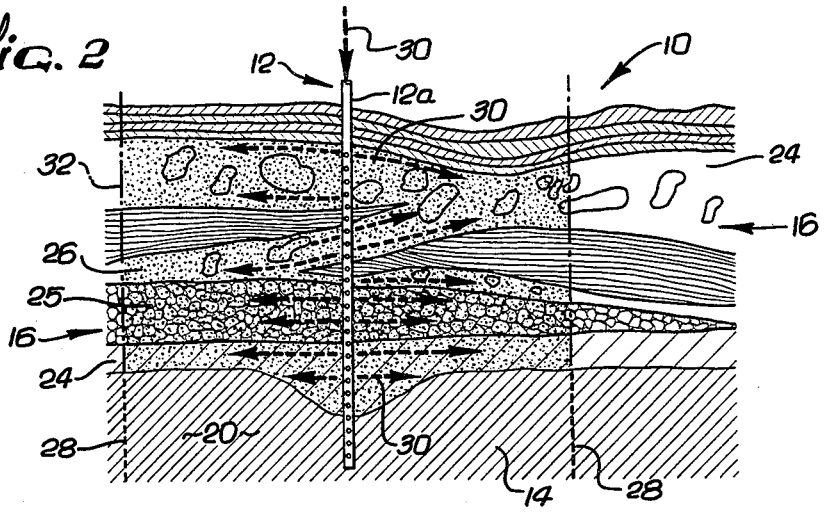
FIG. 2 is the same reservoir as shown in FIG. 1 during the injection of foam.
Figure 3:
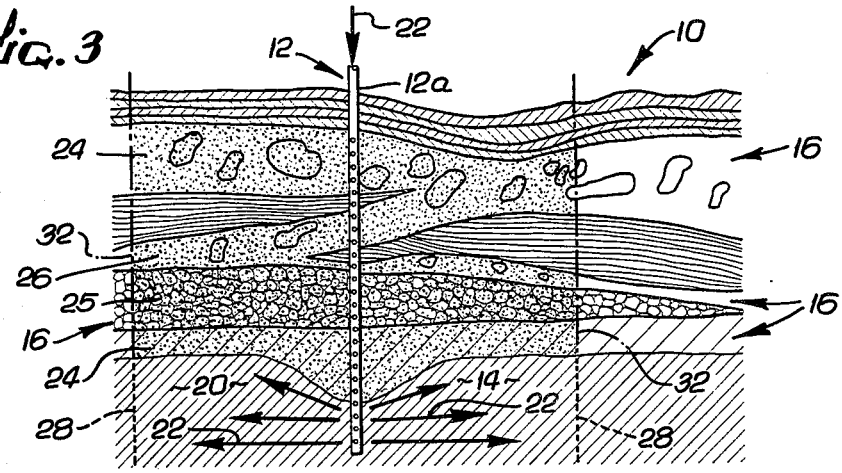
FIG. 3 is the same reservoir as shown in FIG. 2 after the foam is in place and during the injection of steam to stimulate production.

In a single well 12*a* situation (see FIGS. 1–3) operated by cyclic steam stimulation where a significant amount of fluids is present in the well or at least a portion of the permeable zone 16 to be injected with the foam 30, as is frequently the case, it is necessary to eliminate the fluids before injecting foam so that the fluids do not inhibit the flow of the foam. The fluids typically include water, oil and other hydrocarbons. Such is achieved by injection into the reservoir through the well 12*a* of a sufficient amount of steam 22 to substantially eliminate any fluids from the well and from the expanse 32 of the permeable zone to be filled with the foam. The level of fluids prior to the injection of steam is indicated by line 34 in FIG. 1.

When the fluids, if any, have been eliminated, the foam 30 is formed at or about the surface of the well 12*a* by agitating a solution containing the surface active agent and the liquid with pressurized, substantially non-condensible gas. The surface active agent may be an aqueous solution and blend of anionic sodium alfa olefin sulfonate and sodium dodecylbencene sulfonate in a neutral pH range, however, any other suitable surface active agent may be used. Because of its ready availability and cost effectiveness, air may be used as the substantially non-condensible gas, although it is to be understood that other non-condensible gases such as nitrogen and carbon dioxide may also be used. The liquid used with the surface active agent to form the foam may be water, light hydro-carbon liquids or any other suitable liquid, or any suitable mixture thereof.

The formed foam 30 may be injected into the reservoir 10 using the steam 22 as a carrier by feeding the foam into a manifold (not shown) attached to a well head (not shown) for the well 12*a*, and continuing the injection of steam throughout the foaming phase. Where it is desirable, the steam injection may be interrupted and pressurized air used as a carrier for the foam. The use of air has the benefit of placing an amount of substantially non-condensible gas in the permeable zone, in addition to the foam 30, to improve the insulating effect of the present invention.

The formed foam 30 is injected into the well 12*a* until a well bore injection pressure of the foam is achieved which approaches a maximum stabilization injection pressure (i.e., the maximum pressure achieved without significantly increasing the rate of flow of the foam or its viscosity), but which does not exceed the reservoir fracturing pressure. In such manner a controlled filling of the permeable zone 16 with foam, to the extent possible, is achieved without fracturing of the reservoir 10. In most reservoirs 10 the injection of the foam 30 as described herein will extend the foam radially outward from the well 12*a* to the usual extent the permeable zone 16 is in substantial radial proximity with the portion 28 of the oil-bearing strata 14 to be stimulated. Since the foam 30 being injected is substantially insensitive to the conditions of temperature and pressure in the reservoir 10, it is unnecessary to preheat the reservoir or rely on the presence of sufficient steam to form and maintain the foam, such as is necessary with steam-foam.

With the foam 30 in place in the permeable zone 16, a sufficient amount of steam 22 is injected into the oil-bearing strata 14 through the well 12*a* to reduce the viscosity of the oil 20 contained therein and cause it to flow toward the well. The presence of the foam 30 in the permeable zone 16 diverts most of the steam 22 injected into the well 12*a* to the less permeable oil-bearing strata 14 where it will enter the reservoir 10. As a result of the thermally insulating barrier formed by the foam 30 in the permeable zone 16 along the expanse 32 thereof which is in substantial proximity with the portion 28 of the oil-bearing strata 14 to be stimulated, the steam 22 injected into the oil-bearing strata is prevented from migrating through the oil-bearing strata and into the permeable zone. Furthermore, because the foam acts as an insulator, the heat already transferred to the oil-bearing strata 14 is maintained therein and not lost to the permeable zone 16 by conduction.

In many reservoirs, after a sufficient amount of steam 22 is injected into the oil-bearing strata 14 to stimulate oil production, the steam injection is terminated and heat is permitted a sufficient period of time to soak from the injected steam into the portion 28 of the oil-bearing strata 14 to be stimulated. This soak period may take a number of days and is provided not only to permit the transfer of heat from the steam 22 to the oil-bearing strata 14, but to prevent the production of excessive amounts of steam from the well 12*a* when it is returned to production. After the soak period, if any, the oil 20 is withdrawn from the reservoir through the well 12*a*.

In accordance with another aspect of the invention, the injection of steam 22 for purposes of stimulating oil production is continued beyond achieving a stabilization well bore injection pressure, and during the soak period the well bore injection pressure of the injected steam is monitored. If the pressure decreases to or about the stabilization pressure, then additional foam 30 is formed and it is injected into the well 12*a* in the manner previously described. With this process, the loss of steam 22 from within the oil-bearing strata 14 as a result of incomplete foaming, failure of the foam 30 or otherwise is detectible, and additional foam may be injected to complete the foaming or repair the failure. When the additional foam is in place, more steam 22 is injected into the reservoir 10 to stimulate oil production therefrom.

Figure 4:
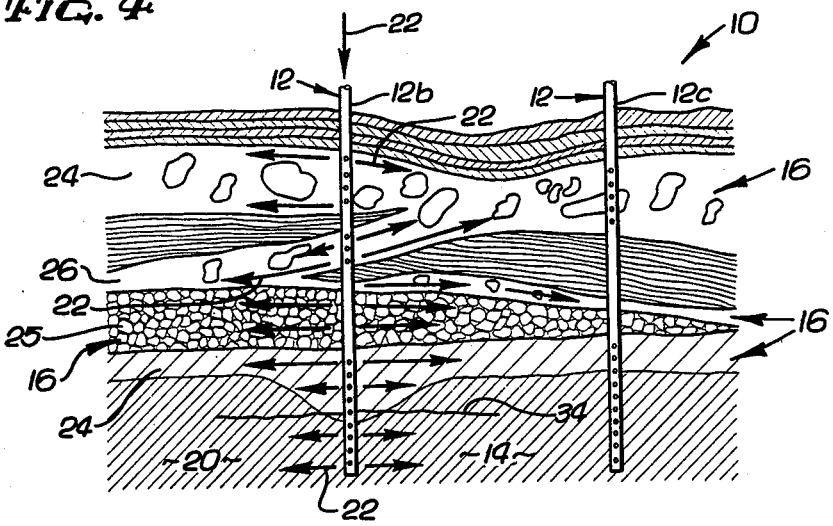
FIG. 4 is a cross section of a reservoir using direct drive steam injection prior to use of the method of the present invention, indicating the paths of steam travel.
Figure 5:
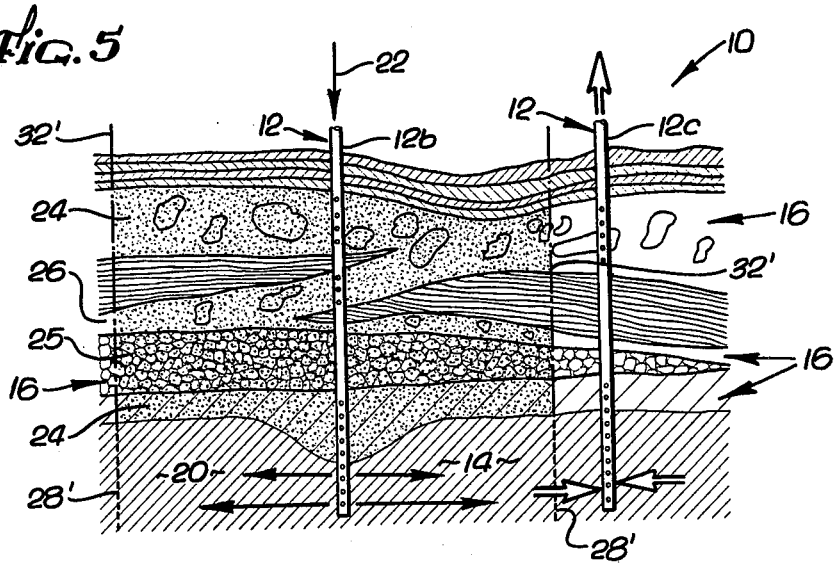
FIG. 5 is a cross section of the same reservoir as shown in FIG. 4 after the foam is in place and during the injection of steam to stimulate production.

The above-described invention may also be practised with some modification on a reservoir 10 operated by direct drive steam injection (see FIG. 4). Again, if a significant amount of fluids is present in the well 12*b* or at least a portion of the permeable zone 16 to be injected with the foam 30, the fluids may be eliminated by the injection of steam to permit the flow of foam.

The foam 30 is formed in the same manner as described above and injected into the well 12*b*. The foam 30 is injected into the injection well 12*b*, and as before, the injection continues until a well bore injection pressure of the foam is achieved which approaches the maximum stabilization injection pressure, but does not exceed the reservoir fracturing pressure. In such manner the foam 30 substantially fills an expanse 32' of the permeable zone 16 which extends substantially radially from the injection well 12*b* and a substantial part of the distance between the injection well and the production well 12*c*. The foam forms a thermally insulating barrier to reduce the loss of steam and heat from the oil-bearing strata to the permeable zone.

With the foam in place, a sufficient amount of steam 22 is injected into the oil-bearing strata 14 through the injection well 12*b* to reduce the viscosity of the oil 20 contained therein and to drive the oil in a portion 28' of the oil-bearing strata 14 to be stimulated toward the production well 12*c*. The oil 20 is withdrawn from the production well 12*c*. The foam 30 serves the same beneficial purposes of diverting the steam 22 to the oil-bearing strata 14, preventing its migration into the permeable zone 16, and insulating the oil-bearing strata from the permeable zone, as described above for the one well situation.

As also described above, the present method provides the convenience of forming the foam at the surface of the well and the ability to use inexpensive and plentiful air as the substantially non-condensible gas. Steam or pressurized air may be used as a carrier for the formed foam. The surface active agent may be used in solution with water as well as other suitable liquids.

It will be appreciated from the foregoing description that the present invention represents a significant advance in the field of steam stimulation. In particular, it provides a method to prevent injected steam from entering permeable zones, both directly from the well and indirectly by migration through the oil-bearing strata, and to prevent loss of heat from the oil-bearing strata by conduction. The method is economically feasible, eliminates the need for preheating of the permeable zone, and can be utilized in reservoirs where heretofore steam stimulation could not be used with optimum results. It will also be appreciated that the foregoing disclosure is given only for purposes of illustration, and various modifications and variations may be made without departing from the spirit and scope of the invention. Accordingly, the invention is not to be limited except as by the appended claims.

I claim:

1. A method for recovering oil from a subterranean oil-bearing reservoir, utilizing a single well operated by steam stiumlation, said reservoir having a permeable zone and an oil-bearing strata with a portion thereof to be stimulated by steam injection, which comprises:

(a) injecting into said reservoir through said well a sufficient amount of steam to substantially eliminate any fluids from said well and from an expanse of said permeable zone which extends substantially radially from said well to the extent said permeable zone is in substantial proximity with said portion of said oil-bearing strata to be stimulated, (b) agitating with a pressurized, substantially non-condensible gas at or about the surface of said well a solution containing a sufficient amount of a surface active agent and a liquid to form a relatively stable, substantially non-condensible, thermally insulating foam having said non-condensible gas as a gas phase, (c) injecting said formed foam into said well until achieving a well bore injection pressure of said foam approaching a maximum stabilization injection pressure, but not exceeding the reservoir fracturing pressure, to position said foam in said permeable zone and substantially fill said expanse of said permeable zone with said foam to form a thermally insulating barrier to reduce loss of steam and heat from said oil-bearing strata to said permeable zone, (d) injecting into said reservoir through said well after formation of said thermally insulating barrier a sufficient amount of additional steam to heat said portion of said oil-bearing strata to stimulate oil production therefrom, (e) terminating substantially all steam injection into said reservoir and permitting heat to soak from said injected steam into said portion of said oil-bearing strata, and (f) withdrawing oil from said reservoir through said well.

2. A method for recovering oil from a subterranean oil-bearing reservoir, utilizing a single well operated by steam stimulation, said reservoir having a permeable zone and an oil-bearing strata with a portion thereof to be stimulated by steam injection, which comprises:

(a) forming foam using a substantially non-condensible gas and a solution containing a sufficient amount of a surface active agent and a liquid, said formed foam being relatively stable, substantially non-condensible, thermally insulating and having said non-condensible gas as a gas phase, (b) injecting said formed foam into said well until achieving a well bore injection pressure of said foam approaching a maximum stabilization injection pressure, but not exceeding the reservoir fracturing pressure, to position said foam in said permeable zone and substantially fill with said foam an expanse of said permeable zone which extends substantially radially from said well to the extent said permeable zone is in substantial proximity with said portion of said oil-bearing strata to be stimulated, to form a thermally insulating barrier to reduce loss of steam and heat from said oil-bearing strata to said permeable zone, (c) injecting into said reservoir through said well after formation of said thermally insulating barrier a sufficient amount of steam to heat said portion of said oil-bearing strata to stimulate oil production therefrom, and (d) withdrawing oil from said reservoir through said well.

3. The method of claim 2, wherein prior to injecting said formed foam into said well, a sufficient amount of steam is injected into said reservoir through said well to substantially eliminate any fluids from said well and from said expanse of said permeable zone.

4. The method of claim 2, wherein prior to withdrawing oil from said reservoir, substantially all steam injection into said reservoir is terminated and heat is permitted a sufficient period of time to soak from said injected steam into said portion of said oil-bearing strata.

5. The method of claim 4, wherein said steam injection to stimulate production is continued beyond achieving a stabilization well bore injection pressure, and during said soak period said well bore injection pressure of said injected steam is monitored and if said injection pressure decreases to or about said stabilization injection pressure then steps (a) and (b) are repeated to position additional foam in said expanse of said permeable zone and step (c) is repeated to provide additional steam in said reservoir.

6. The method of claim 2, wherein said foam is formed at the surface of said well.

7. The method of claim 2, wherein said substantially non-condensible gas is at least one of air, nitrogen or carbon dioxide.

8. The method of claim 2, wherein steam is used as a carrier of said foam to position said foam in said permeable zone.

9. The method of claim 2, wherein pressurized air is used as a carrier of said foam to position said foam in said permeable zone.

10. The method of claim 2, wherein said liquid is water.

11. A method for recovering oil from a subterranean oil-bearing reservoir, utilizing an injection well operated by steam stimulation and a laterally spaced production well, said reservoir having a permeable zone and an oil-bearing strata with a portion thereof to be stimulated by steam injection, which comprises:

(a) injecting into said reservoir through said injection well a sufficient amount of steam to substantially eliminate any fluids from said injection well and from an expanse of said permeable zone which extends substantially radially from said injection well to the extent said permeable zone is in substantial proximity with said portion of said oil-bearing strata to be stimulated, (b) agitating with a pressurized, substantially non-condensible gas at or about the surface of said well a solution containing a sufficient amount of a surface active agent and a liquid to form a relatively stable, substantially non-condensible, thermally insulating foam having said non-condensible gas as a gas phase, (c) injecting said formed foam into said injection well until achieving a well bore injection pressure of said foam approaching a maximum stabilization injection pressure, but not exceeding the reservoir fracturing pressure, to position said foam in said permeable zone and substantially fill said expanse of said permeable zone with said foam to form a thermally insulating barrier to reduce loss of steam and heat from said oil-bearing strata to said permeable zone, (d) injecting into said reservoir through said injection well after formation of said thermally insulating barrier a sufficient amount of additional steam to heat said portion of said oil-bearing strata to stimulate oil production therefrom and to drive said oil toward said production well, and (e) withdrawing oil from said reservoir through said production well.

12. A method for recovering oil from a subterranean oil-bearing reservoir, utilizing an injection well operated by steam stimulation and a laterally spaced production well, said reservoir having a permeable zone and an oil-bearing strata with a portion thereof to be stimulated by steam injection, which comprises:

(a) forming foam using a substantially non-condensible gas and a solution containing a sufficient amount of a surface active agent and a liquid, said formed foam being relatively stable, substantially non-condensible, thermally insulating and having said non-condensible gas as a gas phase, (b) injecting said formed foam into said injection well until achieving a well bore injection pressure of said foam approaching a maximum stabilization injection pressure, but not exceeding the reservoir fracturing pressure, to position said foam in said permeable zone and substantially fill with said foam an expanse of said permeable zone which extends substantially radially from said injection well and a substantial part of the distance between said injection well and said production well, to form a thermally insulating barrier to reduce loss of steam and heat from said oil-bearing strata to said permeable zone, (c) injecting into said reservoir through said injection well after formation of said thermally insulating barrier a sufficient amount of steam to heat said portion of said oil-bearing strata to stimulate oil production therefrom and to drive said oil toward said production well, and (d) withdrawing oil from said reservoir through said production well.

13. The method of claim 12, wherein prior to injecting said formed foam into said injection well, a sufficient amount of steam is injected into said reservoir through said injection well to substantially eliminate any fluids from said injection well and from said expanse of said permeable zone.

14. The method of claim 12, wherein said foam is formed at the surface of said well.

15. The method of claim 12, wherein said substantially non-condensible gas is at least one of air, nitrogen or carbon dioxide.

16. The method of claim 12, wherein steam is used as a carrier of said foam to position said foam in said permeable zone.

17. The method of claim 12, wherein pressurized air is used as a carrier of said foam to position said foam in said permeable zone.

18. The method of claim 12, wherein said liquid is water.

* * * * *